US009945347B2

(12) United States Patent
Burrows et al.

(10) Patent No.: US 9,945,347 B2
(45) Date of Patent: Apr. 17, 2018

(54) WEAR PROTECTION FEATURES FOR CORONA IGNITER

(71) Applicant: Federal-Mogul Ignition Company, Southfield, MI (US)

(72) Inventors: John A. Burrows, Cheshire (GB); Kristapher Mixell, Plymouth, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 369 days.

(21) Appl. No.: 14/215,540

(22) Filed: Mar. 17, 2014

(65) Prior Publication Data

US 2014/0261270 A1 Sep. 18, 2014

Related U.S. Application Data

(60) Provisional application No. 61/799,117, filed on Mar. 15, 2013.

(51) Int. Cl.
*F02P 23/04* (2006.01)
*H01T 19/04* (2006.01)
(Continued)

(52) U.S. Cl.
CPC ..... *F02P 23/04* (2013.01); *H01T 13/50* (2013.01); *H01T 19/00* (2013.01); *H01T 19/02* (2013.01);
(Continued)

(58) Field of Classification Search
CPC ..... F02P 23/00; F02P 23/04; H01T 19/00; H01T 19/02; H01T 19/04
See application file for complete search history.

(56) References Cited

U.S. PATENT DOCUMENTS 4,227,234 A * 10/1980 Seanor ..... H01T 19/00 174/110 R
4,402,036 A 8/1983 Hensley et al.
(Continued)

FOREIGN PATENT DOCUMENTS

CN 102859817 A 1/2013
CN 102900586 A 1/2013
(Continued)

OTHER PUBLICATIONS

International Search Report dated Jun. 24, 2014 (PCT/US2014/029902).

*Primary Examiner* — Sizo Vilakazi
*Assistant Examiner* — Kevin R Steckbauer
(74) *Attorney, Agent, or Firm* — Robert L. Stearns; Dickinson Wright, PLLC

(57) ABSTRACT

A corona igniter comprises an electrode with a central extended member extending along a central axis and a crown extending radially outwardly from the central extended member. The central extended member has an extended length and the crown has a crown length. The extended length is greater than the crown length such that the extended member approaches a piston more closely than the crown. In addition, the firing tips of the crown each present a first spherical radius which is less than a second spherical radius of the central extended member. Thus, if arcing occurs, it forms from the central extended member, rather than from the crown. Accordingly, the firing tips of the crown experience less wear and remain sharp. In addition, due to the sizes of the spherical radii, corona discharge is more likely to form from the firing tips than from the central extended member.

27 Claims, 14 Drawing Sheets

(51) Int. Cl.

| | |
|---|---|
| ***H01T 19/02*** | (2006.01) |
| ***H01T 19/00*** | (2006.01) |
| ***H01T 13/50*** | (2006.01) |
| *H01T 21/02* | (2006.01) |
| *H01T 21/00* | (2006.01) |
| *H01T 13/46* | (2006.01) |

(52) U.S. Cl.
CPC ..... *H01T 19/04* (2013.01); *H01T 13/467* (2013.01); *H01T 21/00* (2013.01); *H01T 21/02* (2013.01); *Y10T 29/49002* (2015.01)

(56) References Cited

U.S. PATENT DOCUMENTS 4,774,914 A 10/1988 Ward
4,841,925 A * 6/1989 Ward ..... F02P 3/0884 123/143 B
5,019,709 A * 5/1991 Pfaff ..... H01T 19/04 250/324
5,273,474 A * 12/1993 Oshima ..... H01T 21/02 219/121.64
5,440,198 A * 8/1995 Oshima ..... H01T 13/39 313/141
5,488,222 A * 1/1996 Gault ..... H01T 19/04 250/324
6,608,430 B1 8/2003 Schaus
7,644,698 B2 1/2010 Shiraishi et al.
8,701,638 B2 * 4/2014 Schremmer ..... F02P 3/06 123/598
8,844,490 B2 * 9/2014 Burrows ..... H01T 13/50 123/143 B
8,857,396 B2 * 10/2014 Giffels ..... H01T 13/50 123/169 R
8,863,730 B2 * 10/2014 Achstaetter ..... H01T 13/36 123/143 R
9,010,294 B2 * 4/2015 Burrows ..... F02P 23/04 123/143 B
9,088,136 B2 * 7/2015 Burrows ..... H01T 13/50
9,103,313 B2 * 8/2015 Burrows ..... F02P 9/007
9,685,767 B2 * 6/2017 Firstenberg ..... H01T 19/00
9,751,797 B2 * 9/2017 Firstenberg ..... C03C 8/18
9,755,405 B2 * 9/2017 Mixell ..... H01T 19/00
9,787,064 B2 * 10/2017 Durham ..... H01T 19/04
2004/0100179 A1 5/2004 Boley et al.
2009/0107439 A1 4/2009 Schultz
2010/0083942 A1 4/2010 Lykowski
2011/0146640 A1 * 6/2011 Achstaetter ..... H01T 13/36 123/608
2011/0247579 A1 * 10/2011 Hampton ..... H01T 13/467 123/146.5 R
2012/0055434 A1 * 3/2012 Giffels ..... F02P 15/08 123/169 R
2012/0060785 A1 3/2012 Shimoda
2012/0112620 A1 5/2012 Lykowski et al.
2012/0192824 A1 8/2012 Burrows et al.
2012/0199088 A1 * 8/2012 Burrows ..... F02P 9/007 123/143 B
2012/0279468 A1 * 11/2012 Burrows ..... H01T 13/50 123/143 B
2013/0049566 A1 * 2/2013 Burrows ..... F02P 23/04 313/141
2013/0340697 A1 * 12/2013 Burrows ..... H01T 13/50 123/146.5 R
2014/0327999 A1 * 11/2014 Durham ..... H01T 19/04 361/230
2015/0285206 A1 * 10/2015 Burrows ..... H01T 13/50 123/143 B
2016/0013623 A1 * 1/2016 Zheng ..... H01T 19/04 361/263
2016/0344165 A1 * 11/2016 Firstenberg ..... H01T 19/00
2016/0359301 A1 * 12/2016 Burrows ..... H01T 13/50
2016/0359302 A1 * 12/2016 Burrows ..... H01T 13/50
2017/0025824 A1 * 1/2017 Mixell ..... H01T 13/20
2017/0093135 A1 * 3/2017 Mixell ..... H01T 19/00
2017/0214221 A1 * 7/2017 Subramanian ..... H01T 13/08

FOREIGN PATENT DOCUMENTS

JP 2011210514 A 10/2011
JP 2012512980 A 6/2012
WO 2011135903 A1 11/2011
WO 2012092432 A1 7/2012
WO 2013028603 A1 2/2013

* cited by examiner

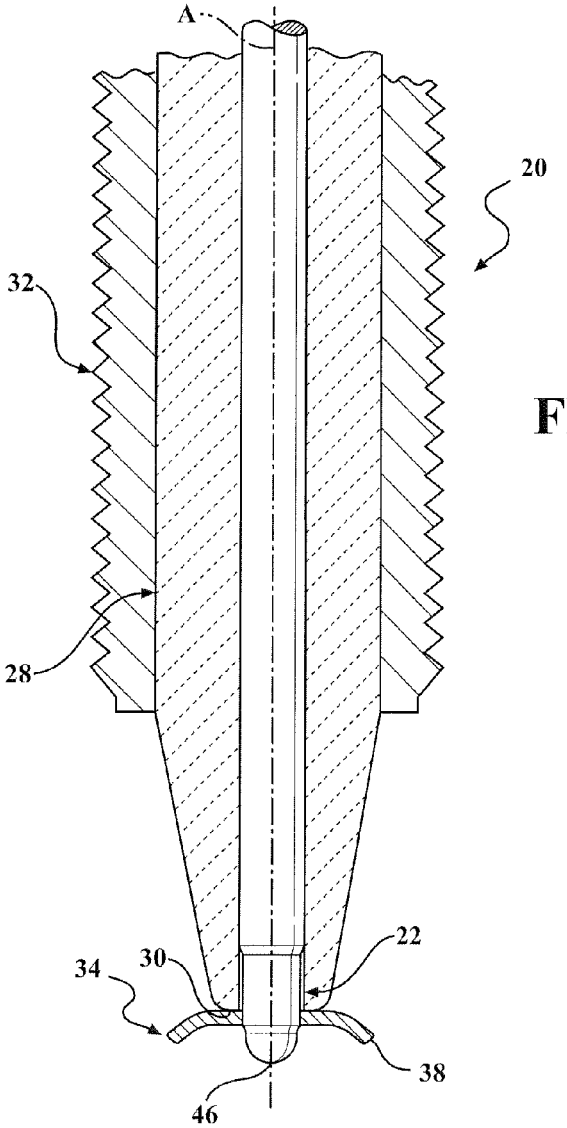
FIG. 1
FIG. 1A
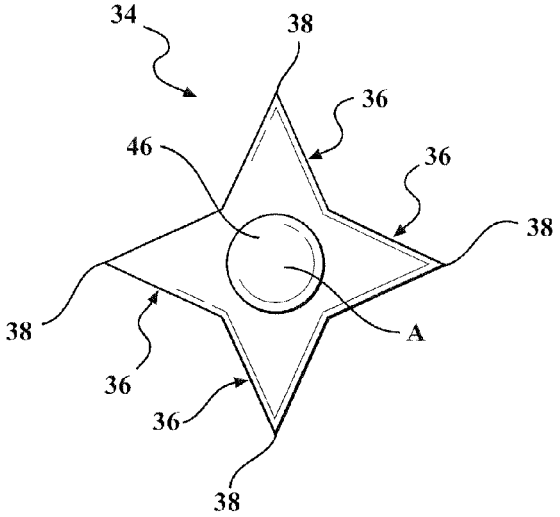

FIG. 18

| Distance Gap to Ground | Spherical Radius | Peak Electric Field @ 1 volt applied |
|---|---|---|
| mm | mm | V/m |
| 0.254 | 0.0508 | 18633.28739 |
| 0.254 | 0.127 | 9980.701716 |
| 0.254 | 0.254 | 6878.930003 |
| 0.254 | 0.508 | 5343.796592 |
| 0.254 | 1.27 | 4477.039363 |
| 0.254 | 2.54 | 4203.304771 |
| 0.508 | 0.0508 | 16136.18133 |
| 0.508 | 0.127 | 8016.138049 |
| 0.508 | 0.254 | 5003.699524 |
| 0.508 | 0.508 | 3441.164495 |
| 0.508 | 1.27 | 2524.355083 |
| 0.508 | 2.54 | 2238.626109 |
| 1.27 | 0.0508 | 13887.23678 |
| 1.27 | 0.127 | 6571.000675 |
| 1.27 | 0.254 | 3798.198319 |
| 1.27 | 0.508 | 2309.525832 |
| 1.27 | 1.27 | 1376.310111 |
| 1.27 | 2.54 | 1068.842433 |
| 2.54 | 0.0508 | 12979.19005 |
| 2.54 | 0.127 | 5922.926914 |
| 2.54 | 0.254 | 3300.830078 |
| 2.54 | 0.508 | 1899.069549 |
| 2.54 | 1.27 | 1000.430464 |
| 2.54 | 2.54 | 688.0533036 |
| 5.08 | 0.0508 | 12172.07443 |
| 5.08 | 0.127 | 5434.093973 |
| 5.08 | 0.254 | 2966.065895 |
| 5.08 | 0.508 | 1650.347304 |
| 5.08 | 1.27 | 802.8204393 |
| 5.08 | 2.54 | 500.131791 |
| 12.7 | 0.0508 | 11006.37994 |
| 12.7 | 0.127 | 4913.879632 |
| 12.7 | 0.254 | 2648.357014 |
| 12.7 | 0.508 | 1438.900864 |
| 12.7 | 1.27 | 659.8844681 |
| 12.7 | 2.54 | 379.6343141 |
| 25.4 | 0.0508 | 9975.942838 |
| 25.4 | 0.127 | 4575.07969 |
| 25.4 | 0.254 | 2461.742392 |
| 25.4 | 0.508 | 1324.304308 |
| 25.4 | 1.27 | 592.6911816 |
| 25.4 | 2.54 | 330 |
| 50.8 | 0.0508 | 8738.021209 |
| 50.8 | 0.127 | 4213.214918 |
| 50.8 | 0.254 | 2288.55173 |
| 50.8 | 0.508 | 1230.835386 |
| 50.8 | 1.27 | 543.0055707 |
| 50.8 | 2.54 | 296.3233774 |

WEAR PROTECTION FEATURES FOR CORONA IGNITER

CROSS REFERENCE TO RELATED APPLICATION

This application claims the benefit of U.S. Provisional Patent Application No. 61/799,117, filed Mar. 15, 2013, the entire contents of which is incorporated herein by reference in its entirety.

BACKGROUND OF THE INVENTION

1. Field of the Invention

This invention relates generally to a corona igniter for emitting a radio frequency electric field to ionize a fuel-air mixture and provide a corona discharge, a corona discharge ignition system, and methods of manufacturing the same.

2. Related Art

A corona igniter of a corona discharge ignition system receives a voltage from a power source and emits an electrical field that forms a corona to ionize a mixture of fuel and air of an internal combustion engine. The igniter includes an electrode extending longitudinally form an electrode terminal end to an electrode firing end. An insulator is disposed along the center electrode, and a shell is disposed along the insulator.

The electrode terminal end receives the voltage from the power source and the electrode firing end emits the electrical field that forms the corona. The electrode of the corona igniter may also include a crown at the firing end for emitting the electrical field. The electrical field includes at least one streamer, and typically a plurality of streamers forming the corona. The mixture of air and fuel is ignited along the entire length of the high electrical field generated from the electrode firing end. An example of a corona igniter is disclosed in U.S. Patent Application Publication No. US 2010/0083942 to Lykowski et al.

In an ideal corona ignition system, the corrosion and/or erosion of the metallic parts of the corona igniter in the combustion chamber is low since a corona discharge does not have the high current and high temperatures associated with the discharge of a conventional spark. Although the corona igniter does not include any grounded electrode element in close proximity to the firing tips of the crown, in some applications, there are grounded engine components that come close to the firing tips. Accordingly, it is not always possible to avoid an arc formation, also referred to as arcing, between the corona igniter and grounded component. If an arc forms, the high current and temperatures associated with the arc formation could cause some erosion and/or corrosion damage to the firing tips of the crown. Overtime, the erosion and/or corrosion damage could decrease the quality of corona formation and combustion.

SUMMARY OF THE INVENTION

One aspect of the invention provides a corona igniter comprising an electrode extending along a central axis for emitting an electrical field that forms a corona, an insulator formed of an electrically insulating material disposed around the electrode and extending along the central axis to an insulator firing end, and a shell formed of a metal material disposed around the insulator. The electrode includes a central extended member extending longitudinally along the central axis to a central firing end. The electrode also includes a crown disposed outwardly of the insulator firing end. The crown includes at least one branch extending radially outwardly of the central extended member. The crown also extends along the central axis from a top surface to at least one firing tip. The crown presents a crown length between the top surface and the at least one firing tip, and the central extended member presents an extended length extending from the top surface of the crown to the central firing end. The crown length and the extended length are parallel to the central axis. The extended length presented by the central extended member is greater than the crown length presented by the crown.

Another aspect of the invention provides a corona discharge ignition system including the corona igniter with the extended length greater than the crown length. The system includes a cylinder head presenting an opening for receiving the corona igniter, a piston disposed opposite the cylinder head and presenting a space therebetween, and a cylinder block connected to the cylinder head and surrounding the piston. The cylinder head, cylinder block, and piston present a combustion chamber therebetween. The corona igniter is position in the opening of the cylinder head such that the central firing end of the central extended member and the crown are disposed in the combustion chamber.

Yet another aspect of the invention provides a method of manufacturing the corona igniter for use in the corona discharge system including the step of providing the central extended member so that the extended length is greater than the crown length.

The corona igniter including the central extended member with the extended length greater than the crown length provides several advantages over comparative corona igniters without the central extended member. When a grounded component, such as the piston, comes close to the central firing end of the central extended member and the firing tips of the crown, if any arc forms it will preferentially form between the piston and central firing end of the central extended member due to the extended length of the central extended member, its proximity to the grounded component, and hence its higher field strength compared to the firing tips of the crown. Therefore, if arcing does occur, corrosion and erosion damage to the firing tips of the crown is reduced.

Furthermore, in situations where the grounded components are far from the corona igniter, the central extended member tends to repel the corona streamers as they form, thereby providing a wider volume of corona discharge and reducing the tendency of the corona discharge to approach the piston and form an arc.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a cross-sectional view of a portion of a corona igniter according to one exemplary embodiment of the invention;

FIG. 1A is a bottom view of a crown of the corona igniter of FIG. 1;

FIG. 18 is a chart including exemplary data which can be used to obtain the peak electric field for a range of spherical radii at various distances from the piston and cylinder block.

DESCRIPTION OF THE ENABLING EMBODIMENT

Figure 1B:
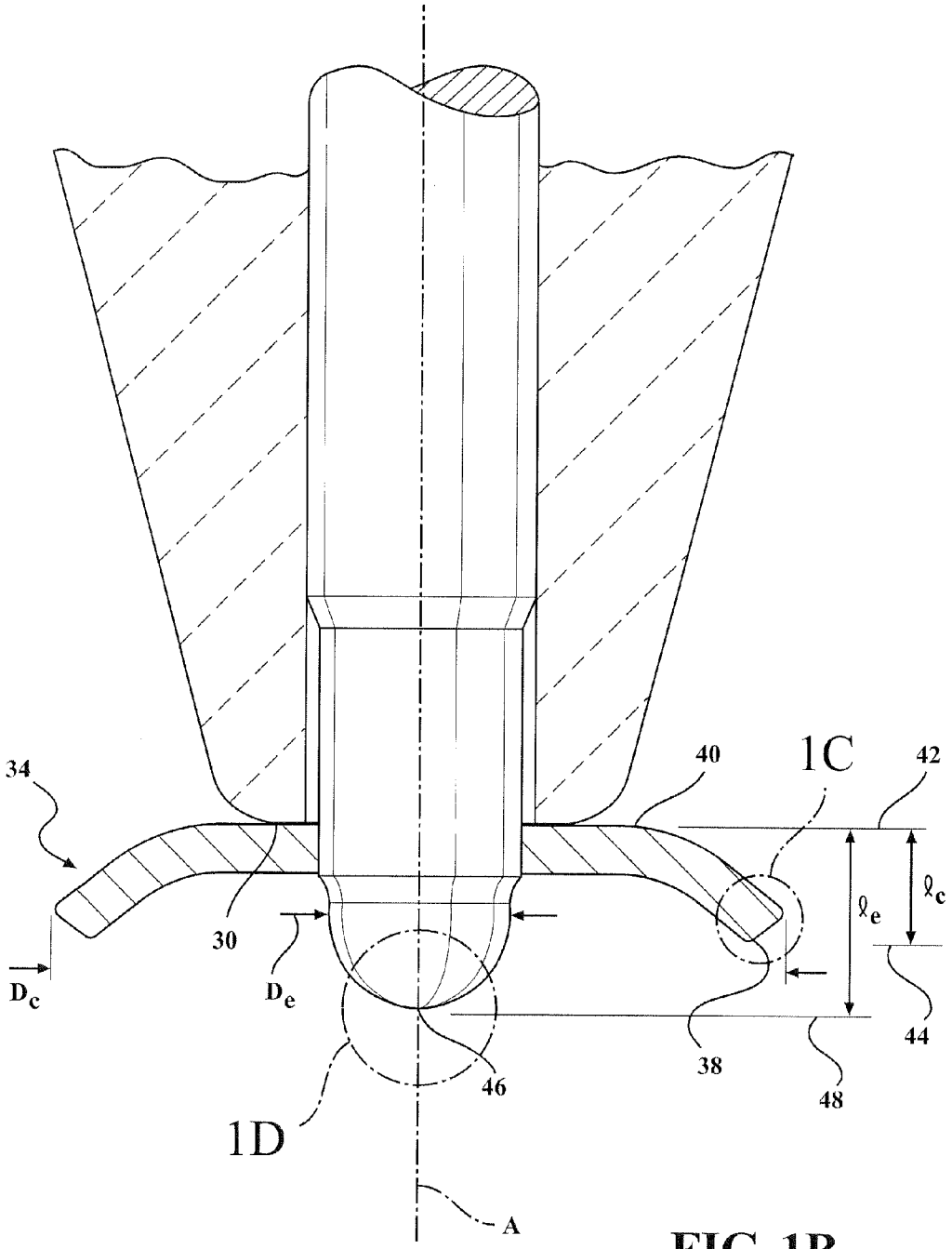
FIG. 1B is an enlarged view of a central extended member and the crown of the corona igniter of FIG. 1.

Referring to the Figures, wherein like numerals indicate corresponding parts throughout the several views, a corona igniter 20 including a central extended member 22 which is capable of providing improved corona discharge 24 and improved combustion performance is generally shown.

As shown in FIG. 1, the corona igniter 20 includes an electrode extending along a central axis A for emitting an electrical field that forms the corona discharge 24. As in conventional corona igniters, an insulator 28 formed of an electrically insulating material, such as alumina, is disposed around the central extended member 22 and extends along the central axis A to an insulator firing end 30. A shell 32 formed of a metal material is disposed around the insulator 28. The electrode includes the central extended member 22 and a crown 34.

The crown 34 of the electrode is disposed outwardly of the insulator firing end 30. The crown 34 surrounds the central axis A and the central extended member 22. The crown 34 of the electrode also includes at least one branch 36 extending radially outwardly of the central extended member 22, but typically includes a plurality of branches 36 each extending radially outwardly from the central axis A and radially outwardly of the central extended member 22. In an exemplary embodiment, the crown 34 includes four branches 36 spaced an equal distance from one another around the central axis A, as shown in FIG. 1A. Each of the branches 36 presents a firing tip 38 for emitting the electrical field that forms the corona discharge 24. As best shown in FIG. 1B, the crown 34 presents a crown diameter $D_c$ disposed perpendicular to the central axis A. The crown diameter $D_c$ is the distance between two points of the crown 34 disposed directly opposite one another, such as the radially outermost points of two opposing firing tips 38.

Also shown in FIG. 1B, the crown 34 extends along the central axis A from a top surface 40 to the at least one firing tip 38. A crown length $l_c$ is thus presented between the top surface 40 and the at least one firing tip 38. As shown in FIG. 1B, the crown length $l_c$ is parallel to the central axis A and it is equal to the distance between a first plane 42 and a second plane 44 each extending perpendicular to the central axis A. The first plane 42 is disposed at the uppermost point of the top surface 40 of the crown 34 and the second plane 44 is disposed at the lowermost point of the lowermost firing tip 38.

Figure 1C:
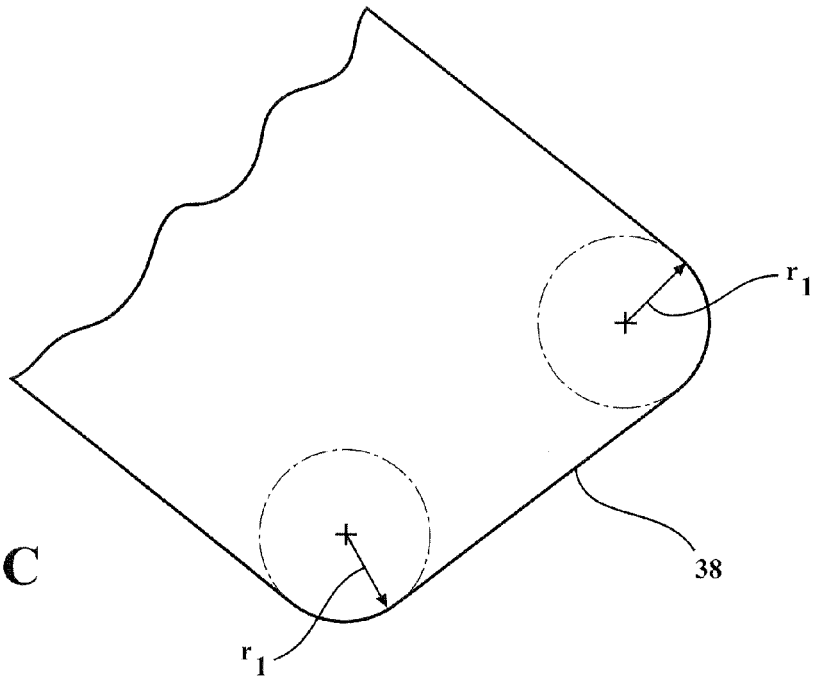
FIG. 1C is an enlarged view of a firing tip of the crown of the corona igniter of FIG. 1 showing a first spherical radius.

Each branch 36 of the crown 34 also presents at least one first spherical radius $r_1$ located at or adjacent to the associated firing tip 38. FIG. 1C shows a portion of the crown 34 of FIG. 1B including two of the first spherical radii $r_1$ at the firing tip 38 of the crown 34. A spherical radius at a particular point along a surface is obtained from a sphere having a radius at that particular point. The spherical radius is the radius of the sphere in three-dimensions, specifically along an x-axis, a y-axis, and a z-axis. In FIG. 1C, the radii $r_1$ are equal, but this is not a requirement, and the radii $r_1$ could be different from one another.

The crown 34 can be formed of various different metal materials. In one exemplary embodiment, the crown 34 is formed of nickel, nickel alloy, or a precious metal, such as platinum or iridium. Due to the central extended member 22 of the electrode, the material of the crown 34 can be formed of a less wear resistant material and experiences less corrosion and erosion if arcing occurs during operation of the corona igniter 20.

The central extended member 22 of the electrode extends longitudinally along the central axis A to a central firing end 46. The central extended member 22 presents an extended length $l_e$ extending from the top surface 40 of the crown 34 to the central firing end 46, as best shown in FIG. 1B. The extended length $l_e$ is parallel to the central axis A and it is equal to the distance between the first plane 42 and a third plane 48 extending perpendicular to the central axis A. The first plane 42 is disposed at the uppermost point of the top surface 40 of the crown 34, and the third plane 48 is disposed at the lowermost point of the central firing end 46. The extended length $l_e$ provided by the central extended member 22 is greater than the crown length $l_c$. Due to the extended length $l_e$, during operation, the central extended member 22 approaches a grounded component, such as the piston, more closely than the firing tips 38 of the crown 34. Thus, if any arcing occurs during operation of the corona igniter 20, the arcing will preferentially form from the central firing end 46 of the central extended member 22, rather than from the firing tips 38 of the crown 34. The extended length $l_e$ of the central extended member 22 can also increase the size of the corona discharge 24 formed by the electrode.

Figure 1D:
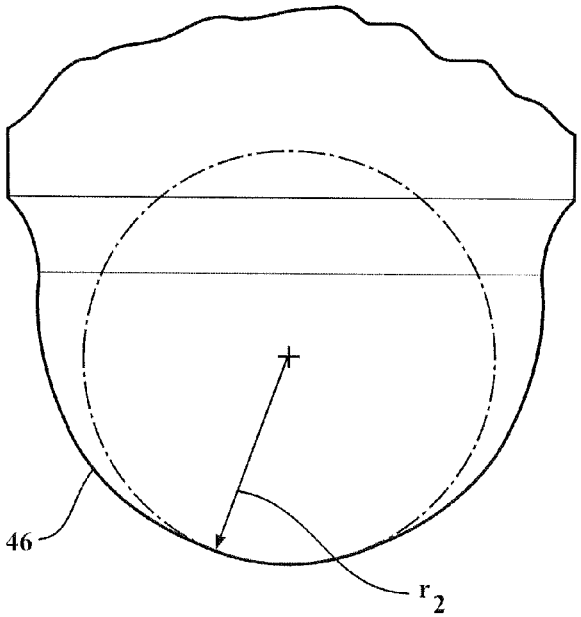
FIG. 1D is an enlarged view of a central firing end of the central extended member of the corona igniter of FIG. 1 showing a second spherical radius.
Figure 2:
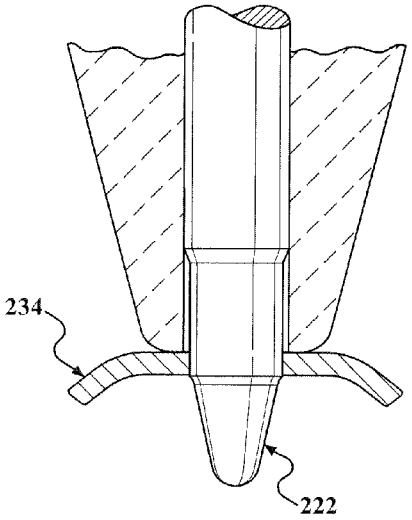
FIGS. 2-11 are cross-sectional views of portions of corona igniters according to other exemplary embodiments of the invention.

The central extended member 22 presents at least one second spherical radius $r_2$ located at or adjacent to the central firing end 46. FIG. 1D shows a second spherical radius $r_2$ at the central firing end 46. Each of the second spherical radii $r_2$ at or adjacent to the central firing end 46 of the central extended member 22 are greater than each of the first spherical radii $r_1$ along the firing tips 38 of the crown 34. In other words, the firing tips 38 of the crown 34 are sharper than the central firing end 46. Therefore, during operation, the electric field is higher at the firing tips 38 of the crown 34, and corona discharge 24 is more likely to form from the firing tips 38 than from the central extended member 22, which is preferred for best combustion performance.

Also shown in FIG. 1B, the central extended member 22 presents an extended diameter $D_e$ disposed perpendicular to the central axis A. The extended diameter $D_e$ may vary along the central axis A, but in the area located between the crown 34 and the central firing end 46, the extended diameter $D_e$ is less than the crown diameter $D_c$.

Figure 3:
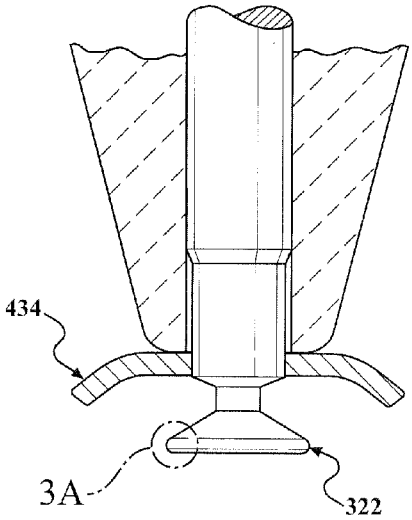
Figure 3A:
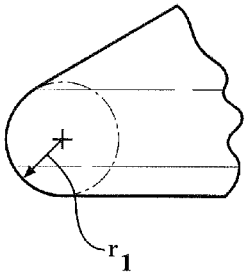
Figure 4:
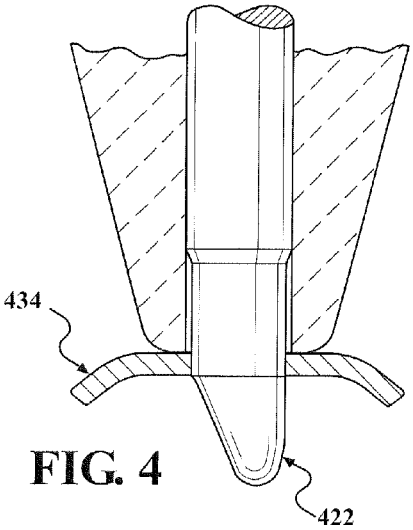
Figure 5:
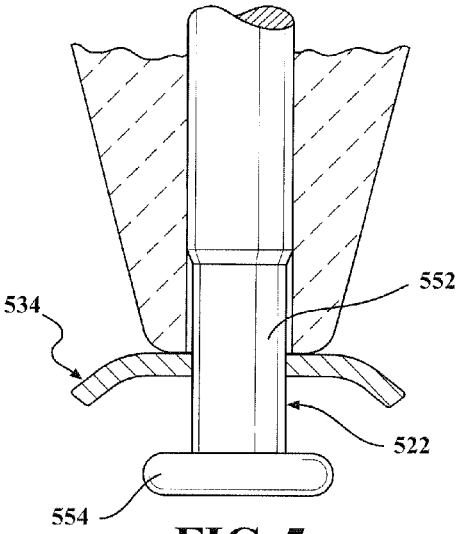
Figure 6:
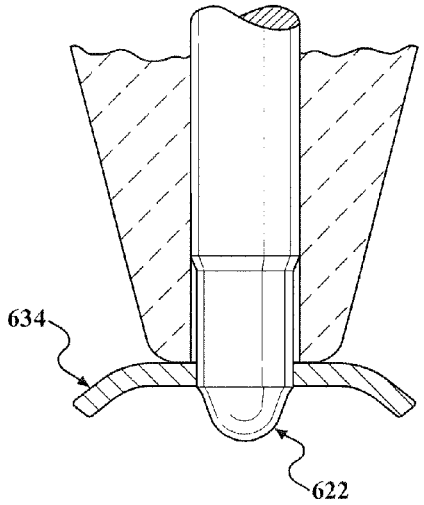
Figure 7:
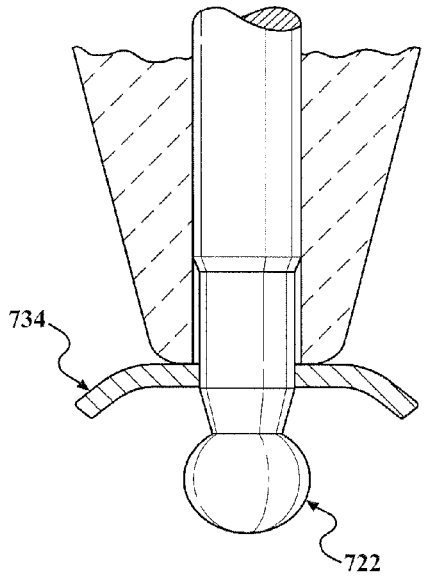
Figure 8:
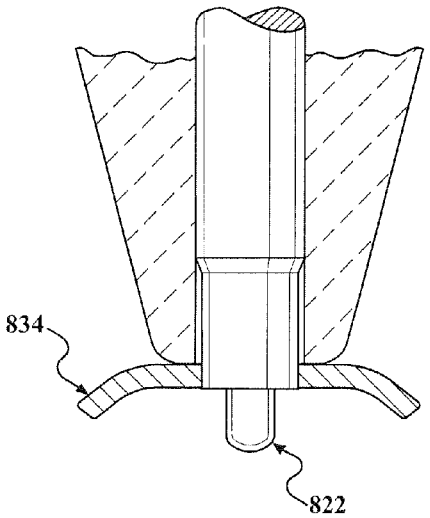
Figure 9:
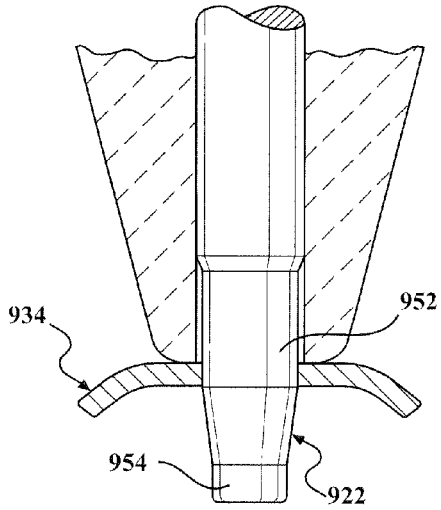
Figure 11:
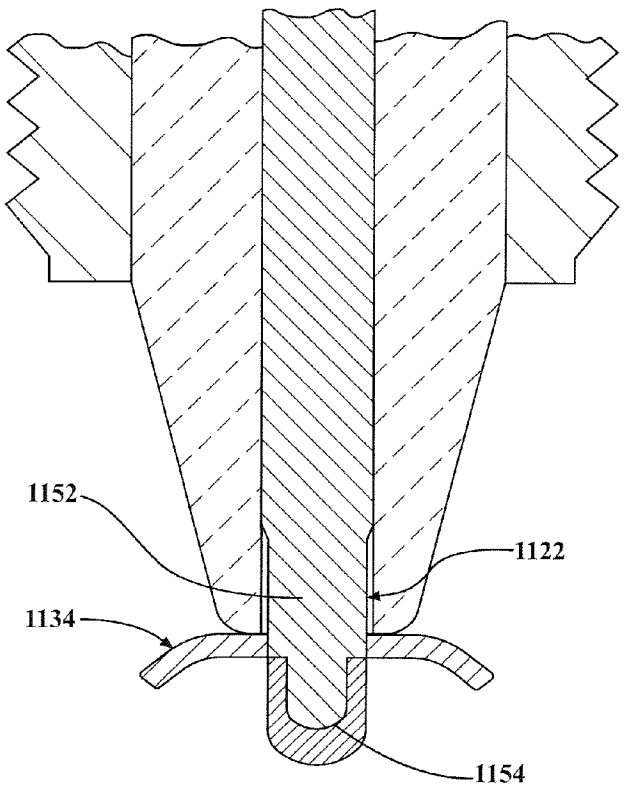

FIGS. 2-11 illustrate other exemplary designs of the corona igniter 20 including the central extended member 22. The designs may be selected to meet the requirements of the particular engine application and to provide the best possible thermal performance. In each case, the extended length $l_e$ of the central extended member 22 is greater than the crown length $l_c$. Also in each embodiment, each of the second spherical radii $r_2$ at or adjacent to the central firing end 46 of the central extended member 22 are greater than each of the first spherical radii $r_1$ at the firing tips 38 of the crown 34. FIG. 3A is an enlarged view of a portion of the design of FIG. 3, wherein the central extended member 322 includes a relatively small second spherical radius $r_2$, but this second spherical radius $r_2$ is still greater than the first spherical radii $r_1$ of the crown 334. In each design, the extended diameter $D_e$ of the central extended member 22 can decrease in a direction moving from the crown 34 toward the central firing end 46, or increase in a direction moving from the crown 34 toward the central firing end 46. In addition, the central extended member 22 does not need to be symmetrical.

Various different materials can be used to form the central extended member 22, such as nickel, copper, precious metals, or alloys thereof. Portions of the central extended member 22 can also be formed of an insulating material. The central extended member 22 is typically formed of a first material and the crown 34 is typically formed of a second material different from the first material. The first material used to form the central extended member 22 is typically more resistant to erosion and corrosion than the second material used to form the crown 34, since the central extended member 22 is more likely to be in contact with high current and temperature of the arc, if arcing does occur. Alternatively, the second material used to form the crown 34 can be more resistant to erosion and corrosion than the first material used to form the central extended member 22.

The central extended member 22 is oftentimes formed of a plurality of separate pieces joined together, such as a body portion 52 and a wear element 54, as shown in FIGS. 5, 9, 10, and 11. However, any of the shapes shown in FIGS. 2-11 could comprise a single piece, or a plurality of pieces joined together. For example, in FIG. 5 the central extended member 522 includes a body portion 552 and a wear element 554 connected to one another. In this embodiment, the wear element 554 is coaxial with the body portion 552, but it does not need to be.

In each embodiment, the wear element 54 presents the central firing end 46. Thus, the wear element 54 is typically formed of a material having good thermal characteristics and being more resistant to wear than the material of the body portion 52. In one embodiment, the wear element 54 is formed of a nickel-based alloy, a noble metal, or a precious metal, such as platinum, tungsten, or iridium. In another embodiment, the wear element 54 is formed of an electrically insulating material preferably having a relative permittivity of greater than 2, and more preferably greater than 8, for example an alumina-based material. The wear element 54 can also comprise a coating of metal material or a coating of electrically insulating material.

The wear element 54 may be applied to the body portion 52 of the central extended member 22 by any suitable means, for example PVD, co-extrusion, or co-sintering. Alternatively, the wear element 54 may be attached by brazing or a similar process. When the wear element 54 is a coating, the coating can be applied by plating, spraying, sintering, or another suitable method. The material of the body portion 52 and the material of the wear element 54 should be selected and joined to provide good bonding, no small gaps, good thermal contact, and to avoid problems with differential thermal expansion, for example.

Figure 10:
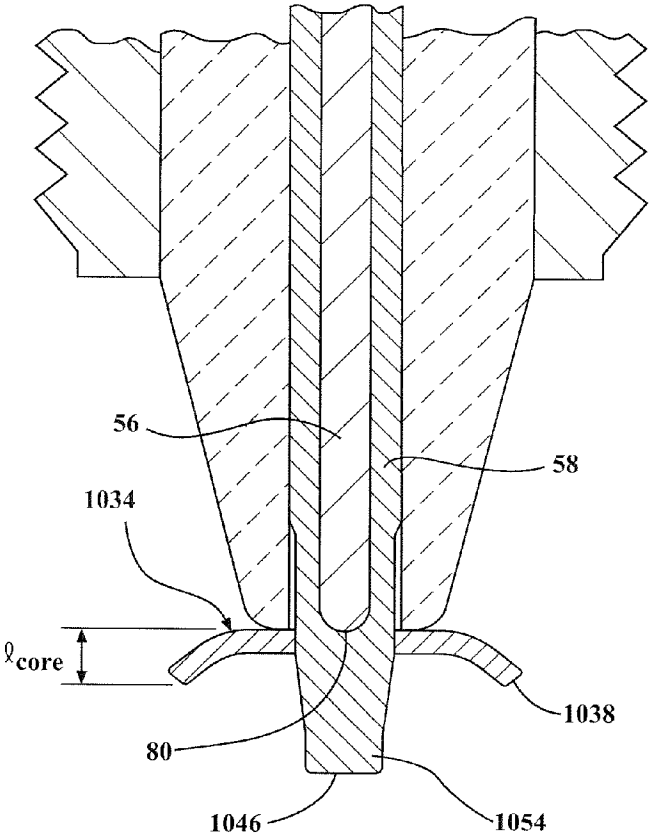

In the embodiment of FIG. 10, in order to better withstand the effects of arc discharge, the central extended member 1022 includes a core 56 formed of copper or a copper alloy, and the core 56 is surrounded by a cladding 58 formed of a nickel alloy. In the embodiment of FIG. 10, the wear element 1054 is attached to the cladding 58 and forms the central firing end 1046. Alternatively, the cladding 58 of the nickel alloy could form the central firing end 1046. As shown in FIG. 10, the core 56 preferably has a core length $l_{core}$ extending from the top surface 1040 of the crown 1034 to a core firing end 80. The core length $l_{core}$ is parallel to the central axis A and it is equal to the distance between the first plane 42 and a fourth plane 82 each extending perpendicular to the central axis A. The fourth plane 82 is disposed at the lowermost point of the core 56. Preferably, the core length $l_{core}$ is greater than the crown length $l_c$. In this case, the cladding 58 of the central extended member 1022 still protects the copper core 56. This design is optional, but it can significantly reduce the maximum temperature of the firing tips 1038 and can prolong the life of the firing tips 1038 and the central firing end 1046.

Figure 12A:
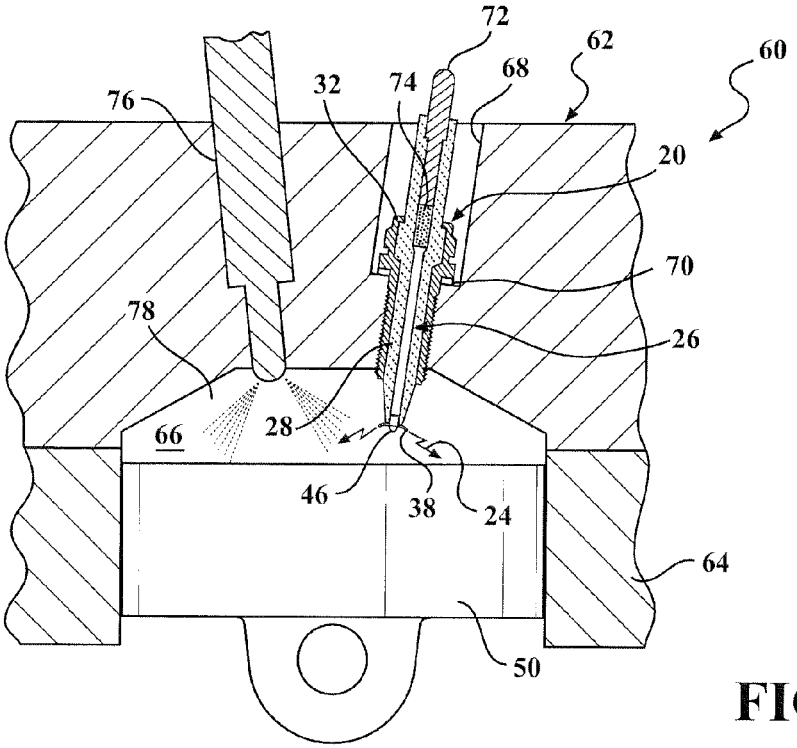
FIG. 12A is a cross-sectional view of a corona discharge ignition system including the corona igniter of FIG. 1 when the corona igniter is spaced from a piston.
Figure 12B:
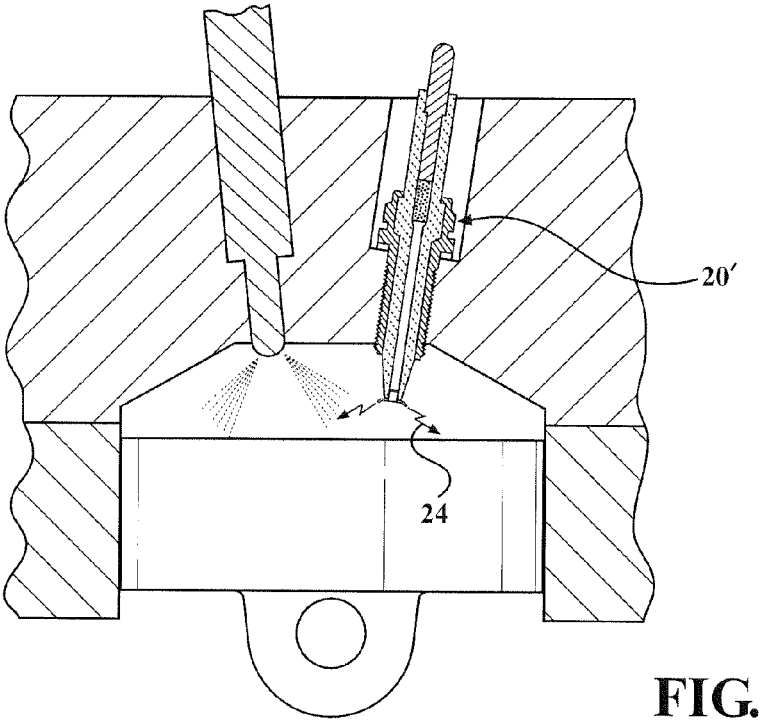
FIG. 12B is a cross-sectional view of the corona ignition system including a comparative corona igniter, without the central extended member of the present invention, when the comparative corona igniter is spaced from the piston by the same distance as the corona igniter of FIG. 12A.
Figure 13A:
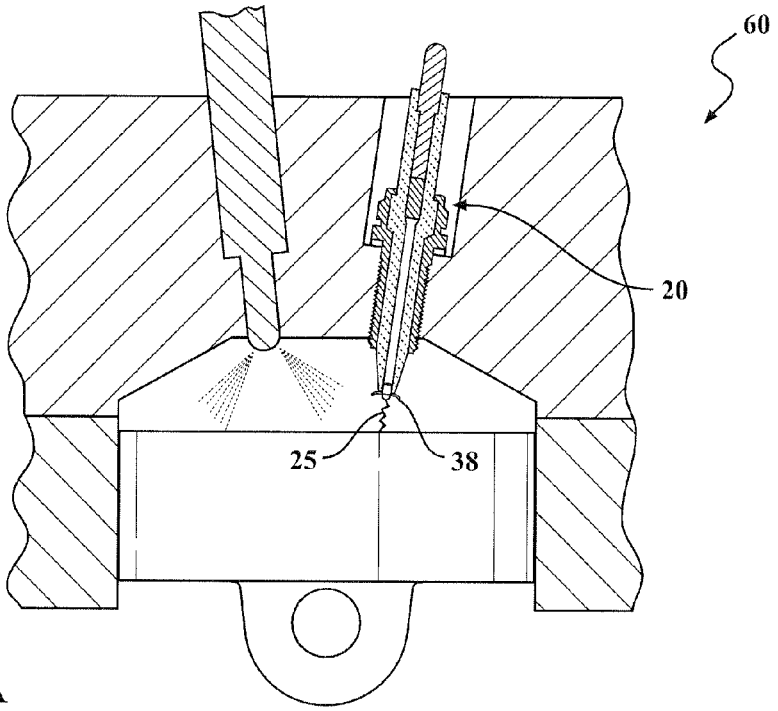
FIG. 13A is a cross-sectional view of the corona ignition system including the corona igniter of FIG. 1 when the corona igniter is close to the piston.
Figure 13B:
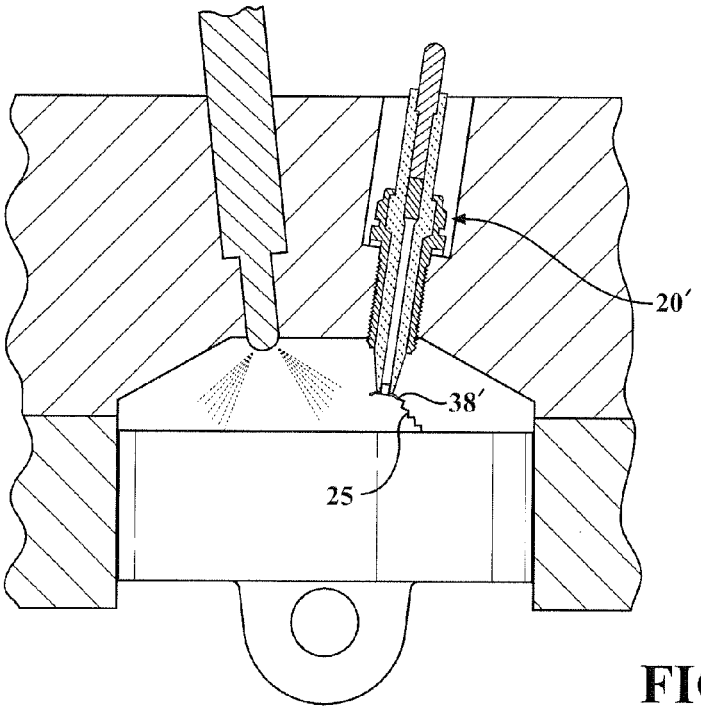
FIG. 13B is a cross-sectional view of the corona ignition system including the comparative corona igniter of FIG. 12B when the comparative corona igniter is in the same position as the corona igniter of FIG. 13A.

Another aspect of the invention provides a corona discharge ignition system 60 including the corona igniter 20 with the central extended member 22 to reduce corrosion and erosion at the firing tips 38, as shown in FIGS. 12A and 13A. For comparison, FIGS. 12B and 13B show a system with another type of corona igniter 20', which does not include the extended length of the present invention. The system 60 includes components found in a conventional internal combustion engine, such as a cylinder head 62, a cylinder block 64, and a piston 50. The piston 50 is disposed opposite the cylinder head 62 and presents a space therebetween, and the cylinder block 64 is connected to the cylinder head 62 and surrounds the piston 50. Thus, the cylinder head 62, cylinder block 64, and piston 50 present a combustion chamber 66 therebetween.

The cylinder head 62 presents an opening 68 for receiving the corona igniter 20. The shell 32 of the corona igniter 20 is typically coupled to the cylinder head 62, for example threaded into the opening 68 of the cylinder head 62, as shown in FIGS. 12 and 13. A gasket 70 is typically disposed between the shell 32 and the cylinder head 62. The corona igniter 20 can include a terminal 72 for receiving the power from a power supply (now shown), and an insulation material 74 can be disposed between the terminal 72 and the electrode. A portion of the insulator 28, as well as the central firing end 46 and the firing tips 38, are disposed in the combustion chamber 66. A fuel injector 76 is also received in the cylinder head 62 for delivering fuel in the form of finely atomized spray 78 into the combustion chamber 66.

During operation, power is supplied to the corona igniter 20, the fuel is sprayed toward the corona igniter 20, and the piston 50 reciprocates with the cylinder block 64, moving towards and away from the cylinder head 62 and the corona igniter 20, as in a conventional corona ignition system. In FIG. 12A, the piston 50 is spaced from the corona igniter 20 by a significant distance. Corona discharge 24 forms from the firing tips 38 of the crown 34, and no arc formation occurs between the corona igniter 20 and the piston 50 or any other grounded component. In the system 60 of FIG. 12B with the comparative corona igniter 20', the corona discharge 24 is also formed without arc formation.

In FIGS. 13A and 13B, however, the piston 50 approaches the corona igniter 20, 20' and arcing 25 does occur. When the system 60 includes the inventive corona igniter 20, such as in FIG. 13A, the arcing 25 does not occur from the firing tips 38 of the crown 34, as it does when the comparative corona igniter 20' of FIG. 13B is used. Rather, the arcing 25 occurs from the central firing end 46 of the central extension member 22. The extended length $l_e$ of the central extended member 22 restricts the arcing 25 to only the central extended member 22. Since the firing tips 38 of the crown 34 are less exposed to the high temperatures caused by the arcing 25, they experience less corrosion and erosion. Thus, the firing tips 38 stay sharp and continue to provide a strong corona discharge 24 during future ignition cycles.

Figure 14A:
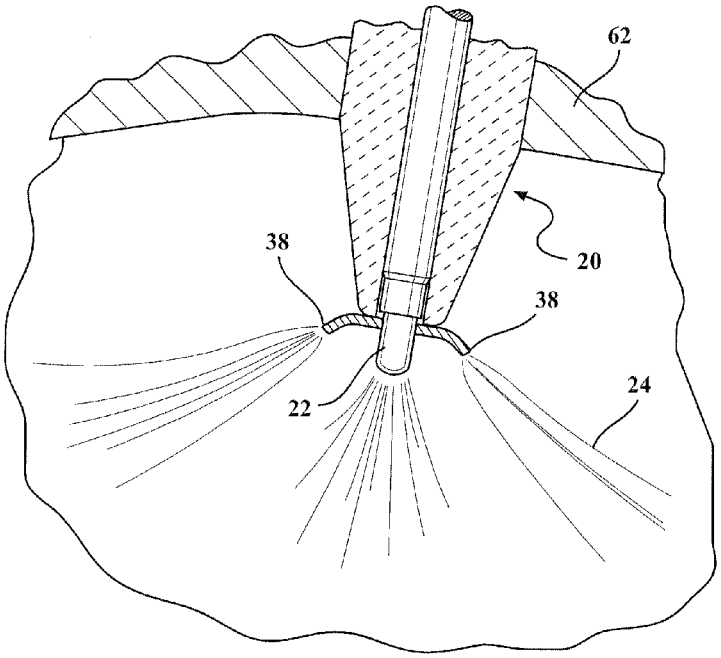
FIG. 14A is a Finite Element Analysis (FEA) of a corona igniter according to another exemplary embodiment of the invention providing a corona discharge when the corona igniter is disposed a distance from a piston.
Figure 14B:
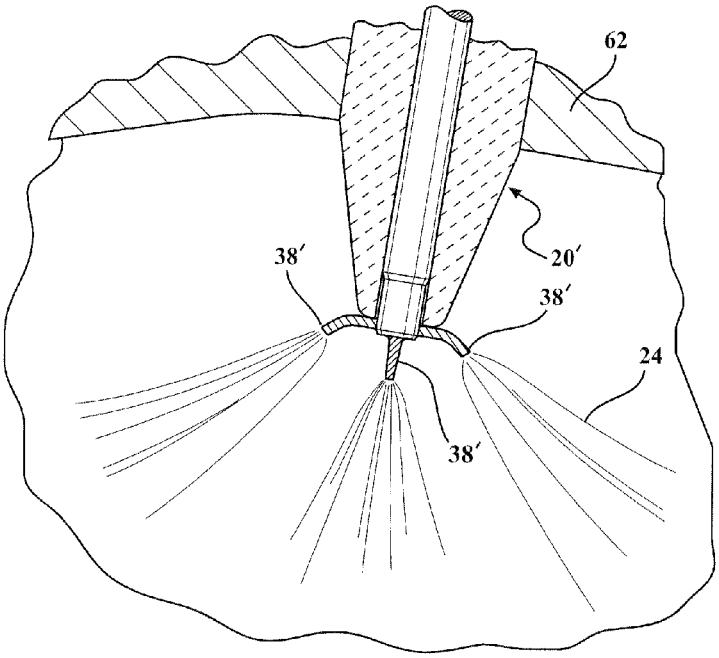
FIG. 14B is FEA of a comparative corona igniter providing a corona discharge when the comparative corona igniter is disposed the same distance from the piston as the corona igniter of FIG. 14A.
Figure 15A:
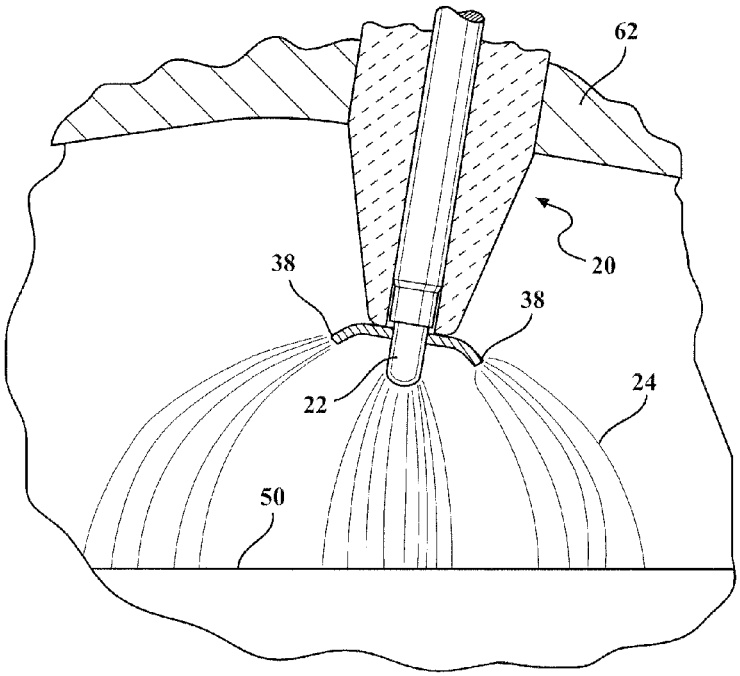
FIG. 15A is a FEA of the corona igniter of FIG. 14A providing a corona discharge when the corona igniter is disposed at a typical location of ignition.

As mentioned above, the electrode of the corona igniter 20 of the present invention can also increase the size of the corona discharge 24 during operation. FIGS. 14-16 each include a Finite Element Analysis (FEA) of an inventive corona igniter 20 or a comparative corona igniter 20' when power is supplied to the corona igniter 20, 20'. The lines of the FEA images show the most likely direction and length of the corona discharge 24. FIG. 14A shows the inventive corona igniter 20 and associated corona discharge 24 when the piston 50 is spaced a significant distance from the central firing end 46 and firing tips 38; FIG. 15A shows the inventive corona igniter 20 and the associated corona discharge 24 when the piston 50 is at the location of typical ignition; and FIG. 16A shows arcing 25 which occurs from the central firing end 46 of the inventive corona igniter 20 when the piston 50 comes very close to the corona igniter 20. For comparison, FIGS. 14B-16B each include a FEA of the corona discharge 24 provided by the comparative corona igniter 20' when the piston 50 is in the same positions as FIGS. 14A-16A.

Figure 15B:
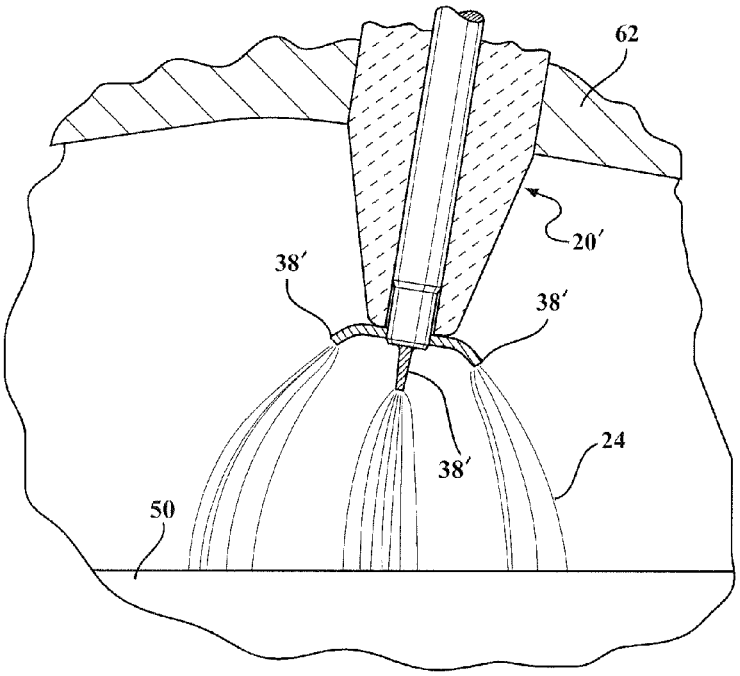
FIG. 15B is a FEA of the comparative corona igniter of FIG. 14B providing a corona discharge when the comparative corona igniter is disposed at the typical location of ignition.
Figure 16A:
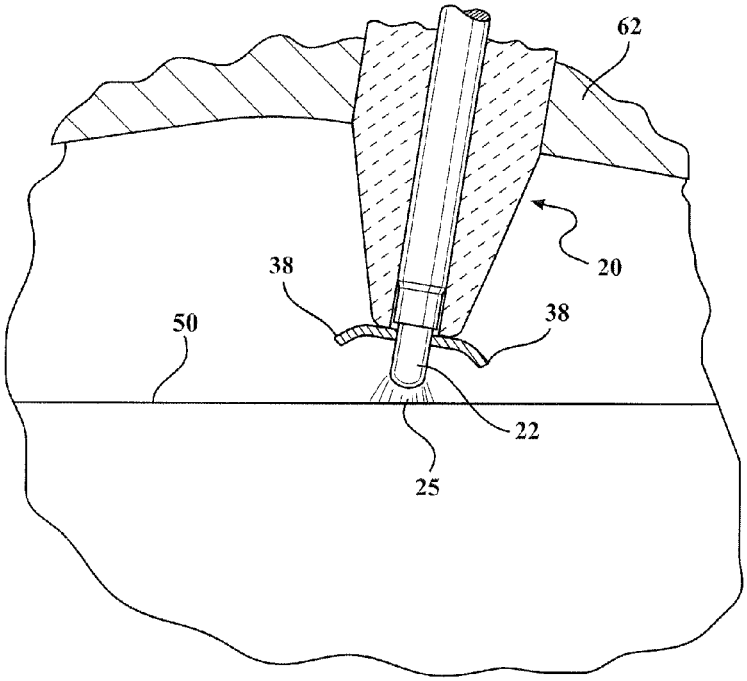
FIG. 16A is a FEA of the corona igniter of FIG. 14A when the corona igniter is disposed closest to the piston, and wherein arcing occurs from the central extended member of the corona igniter.
Figure 16B:
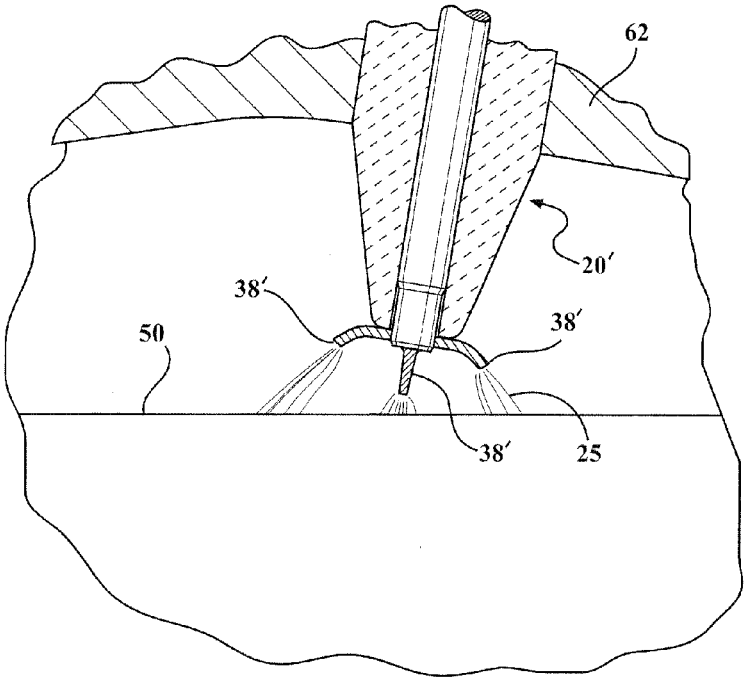
FIG. 16B is a FEA of the comparative corona igniter of FIG. 14B when the comparative corona igniter is disposed at the same distance from the piston as the corona igniter of FIG. 16A, and wherein arcing occurs from the crown of the comparative corona igniter.

FIGS. 14A and 15A show that the corona igniter 20 of the present invention provides a greater volume of corona discharge 24 when the piston 50 is spaced from the corona igniter 20, relative to the comparative corona igniter 20' of FIGS. 14B and 15B. The extended length $l_e$ of the central extended member 22 tends to repel the corona streamers as they form, thus providing a more open shape, giving a larger volume, and being less likely to encounter the piston 50. In addition, FIG. 16A shows that if arcing 25 occurs, the arcing will form from the central firing end 46 of the central extended member 22, rather than from the firing tips 38 of the crown 34. This is an advantage over the comparative corona igniter 20' of FIG. 16B, wherein the arcing 25 forms from the firing tips 38' of the crown 34'.

Figure 17:
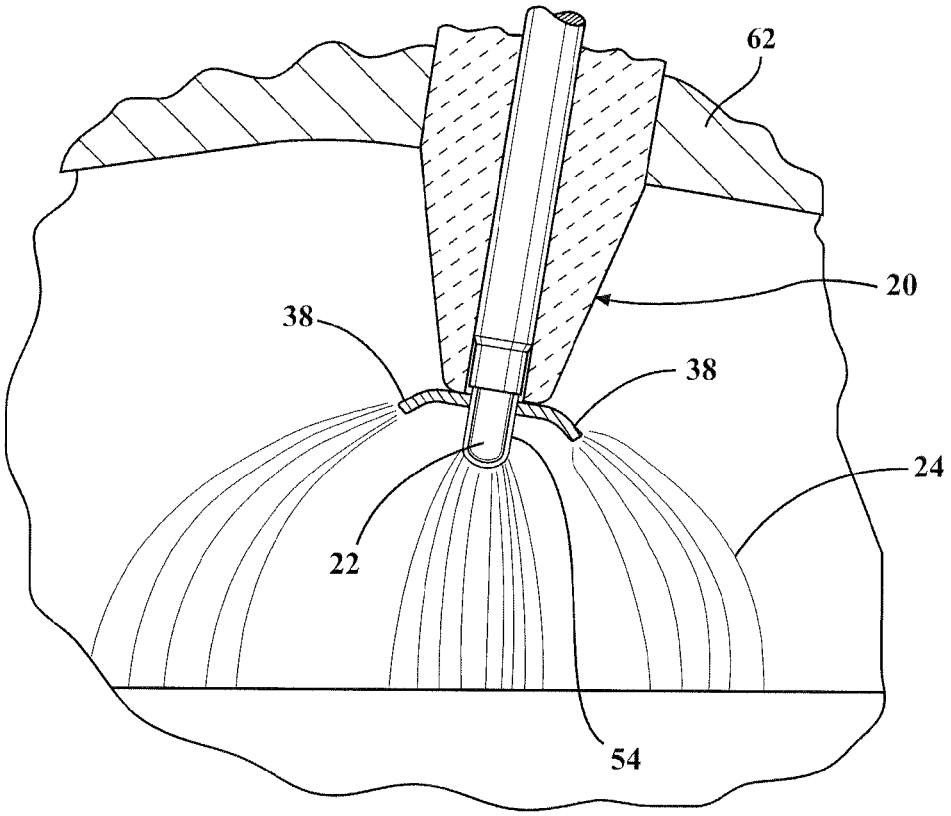
FIG. 17 is a FEA of the corona igniter of FIG. 14A when an insulating coating is applied to the central extended member.

FIG. 17 is a FEA analysis of the inventive corona igniter 20 when the wear element 54 in the form of an insulating coating is applied over the central firing end 46 of the central extended member 22. This analysis shows that the insulating coating does not detrimentally effect the operation of the corona igniter 20 or the benefits provided by the central extended member 22. However, the insulating coating may provide increased endurance of the corona igniter 20 by mitigating the effects of corrosion and erosion at the central firing end 46.

Another aspect of the invention provides a method of manufacturing the corona igniter 20 for use in the corona discharge ignition system 60, which includes providing the central extended member 22 so that the extended length $l_e$ of the central extended member 22 is greater than the crown length $l_c$.

Various techniques can be used to determine the appropriate extended length $l_e$ of the central extended member 22 in order to provide the preferred performance. In one embodiment, the method first includes (a) identifying the firing tip 38 of the crown 34 which will be closest to the cylinder block 64 when the corona igniter 20 is received in the cylinder head 62. Next, the method includes (b) determining a point during movement of the piston 50 where a distance from the firing tip 38 identified in step (a) to the cylinder block 64 is equal to a distance from the firing tip 38 identified in step (a) to the piston 50. When the piston 50 is located at this point, or closer to the firing tips 38, there is a possibility of arcing between the firing tips 38 and piston 50, but this possibility is mitigated by the central extended member 22.

The method next includes (c) selecting the extended length $l_e$ of the central extended member 22 such that when power is provided to the electrode and when the firing tip 38 identified in step (a) is at the point identified in step (b), the peak electric field at the central firing end 46 of the central extended member 22 is equal to or greater than the peak electric field at the firing tip 38 identified in step (a). The peak electric field at the central firing end 46 of the central extended member 22 depends on the distance between the central firing end 46 and the piston 50, and the distance between the central firing end 46 and the cylinder block 64. The method can also include adjusting the extended length $l_e$ of the central extended member 22 to space the central firing end 46 of the central extended member 22 farther from the cylinder block 64 and/or the piston 50 during operation.

The method also typically includes step (d): selecting the first spherical radii $r_1$ of the firing tips 38 and the second spherical radii $r_2$ of the central firing end 46 such that during operation, corona discharge will preferentially form from the firing tips 38, and arcing, if any occurs, will preferentially form between the piston 50 and the central firing end 46 of the central extended member 22. The step of selecting the spherical radii $r_1$, $r_2$ can be conducted before or after selecting the extended length $l_e$. The step of selecting the spherical radii $r_1$, $r_2$ includes selecting the first spherical radii $r_1$ for each of the firing tips 38 of the crown 34 and selecting the second spherical radii $r_2$ for the central firing end 46 of the central extended member 22 such that each of the first spherical radii $r_1$ at the firing tips 38 of the crown 34 are smaller than the second spherical radii $r_2$ of the central extended member 22.

The spherical radii $r_1$, $r_2$ are preferably selected so that when power is provided to the electrode, and the at least one firing tip 38 of the crown 34 and the central firing end 46 of the central extended member 22 are spaced from the cylinder block 64 and the piston 50, and a corona discharge 24 is provided from the firing tips 38, the peak electric field at the firing tip 38 closest to ground is at least 25% higher than the peak electric field at the central firing end 46 of the central extended member 22. This may be achieved, for example, by using data of the form shown in FIG. 18. The first column of FIG. 18 is the distance, in millimeters, from the central firing end 46 or the firing tip 38 to ground, also referred to as the gap to ground. The second column is the spherical radius, in millimeters, and it could be the spherical radius of either the central firing end 46 or the firing tip 38. The third column is the peak electric field, in volts per meter, when 1 volt is applied. The values in FIG. 18 are only examples. A dimensionless relationship between the spherical radii $r_2$ of the central firing end 46 of the central extended member 22, the spherical radii $r_1$ of the firing tips 38, and the extended length $l_e$ of the central extended member 22 could be obtained based on the data in FIG. 18.

Figure 19:
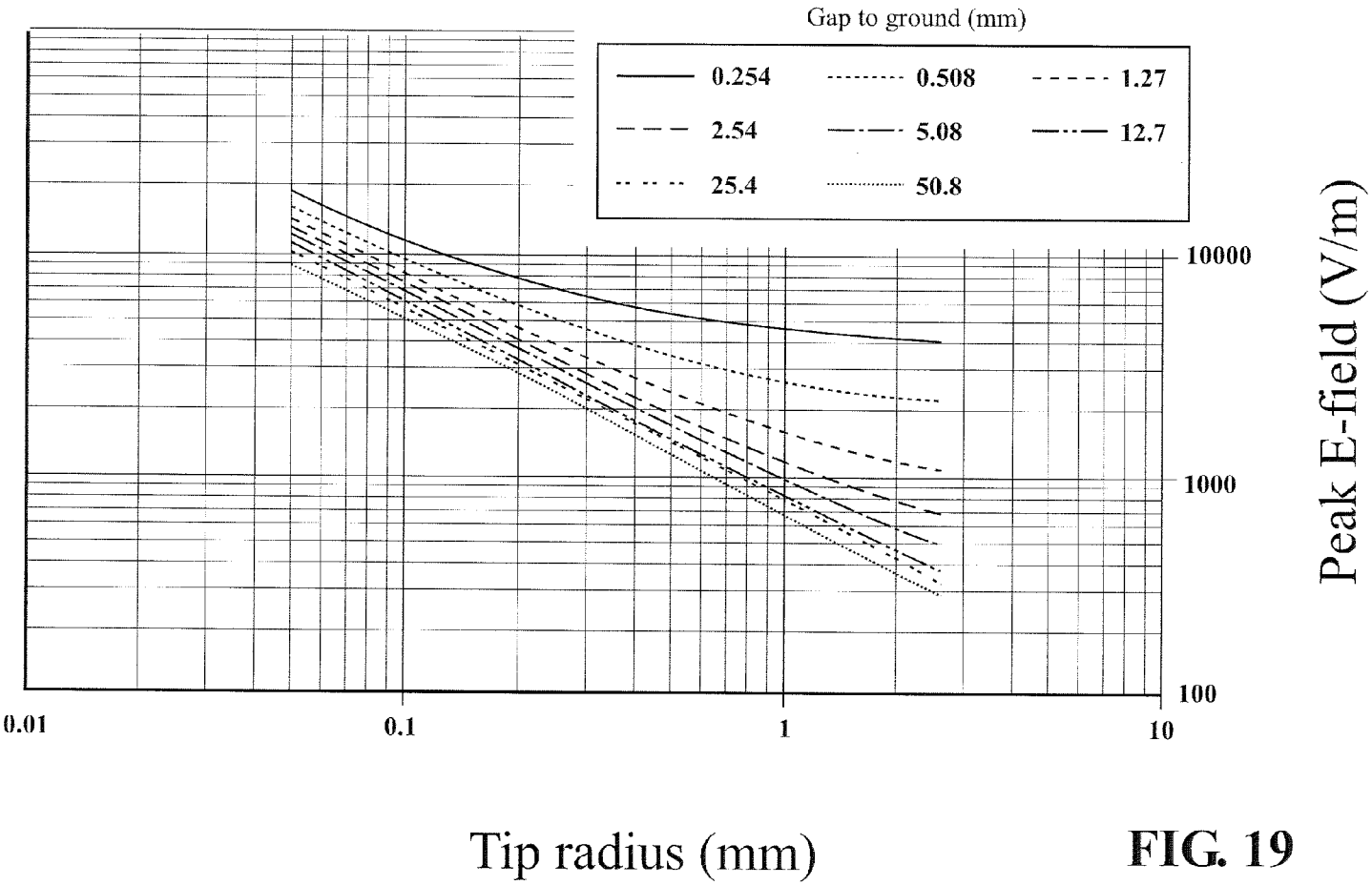
FIG. 19 is a graph providing the peak electric field for a range of spherical radii at various distances from the piston and cylinder block.

FIG. 19 is a graph providing the peak electric field for spherical radii ranging from about 0.05 mm to about 1.15 mm at various distances from the piston 50 and cylinder block 64. FIG. 19 specifically provides the peak electric field when the distance from the firing tip 38 to the piston 50 and to the cylinder block 64 is 0.254 mm, 0.508 mm, 1.27 mm, 2.54 mm, 5.08 mm, 12.7 mm, 24.5 mm, and 50.8 mm. The peak electric field at the firing tip 38 should be 25% higher than the peak electric field at the central firing end 46 of the central extended member 22 only at the larger distances, but this is not required at the shorter distances, for example only at 50.8 mm, but not at 0.254 mm.

Once the distance is identified in step (b), and the spherical radii $r_1$, $r_2$ are selected in step (d), the method typically includes (e) determining the peak electric field of the firing tip 38 identified in step (a) at the distance identified in step (b). As an example again, the data of FIG. 18 can be used to determine this peak electric field. In one preferred embodiment, the firing tips 38 each have a spherical radius $r_1$ of 2.54 mm and a peak electric field of 330 V/m at a distance of 25.4 mm from the piston 50. The method can further include adjusting the spherical radii $r_1$, $r_2$ to meet all safety and operating conditions.

Obviously, many modifications and variations of the present invention are possible in light of the above teachings and may be practiced otherwise than as specifically described while within the scope of the appended claims.

What is claimed is:

1. A corona igniter, comprising:

an electrode extending along a central axis for emitting an electrical field that forms a corona discharge;

said electrode including a central extended member extending longitudinally along said central axis to a central firing end;

an insulator formed of an electrically insulating material disposed around said electrode and extending along said central axis to an insulator firing end;

a shell formed of a metal material disposed around said insulator;

said electrode including a crown disposed outwardly of said insulator firing end;

said crown extending radially outwardly of said central extended member to at least one firing tip; and said crown presenting at least one first spherical radius at each firing tip, said central extended member presenting at least one second spherical radius at said central firing end, each first spherical radius being smaller than each second spherical radius.

2. The corona igniter of claim 1 wherein said crown includes a plurality of branches each extending to one of said firing tips, each of said firing tips having at least one of said first spherical radii each being smaller than each of said second spherical radii.

3. The corona igniter of claim 1 wherein said central extended member is formed of a first material and said crown is formed of a second material different from said first material, and said first material is more resistant to erosion and/or corrosion than said second material.

4. The corona igniter of claim 1 wherein said central extended member includes a core formed of copper or a copper alloy and a cladding formed of a nickel alloy surrounding said core, and said cladding of said central extended member presents said central firing end.

5. The corona igniter of claim 4 wherein said core has a core length extending from said top surface of said crown to a core firing end, and said core length is greater than said crown length.

6. The corona igniter of claim 1 wherein said central extended member includes a plurality of separate pieces joined together.

7. The corona igniter of claim 1 wherein said central extended member includes a body portion and a wear element connected to one another, and said wear element presents said central firing end.

8. The corona igniter of claim 7 wherein said wear element is formed of a nickel-based alloy, a noble metal, or a precious metal.

9. The corona igniter of claim 7 wherein said wear element is a coating.

10. The corona igniter of claim 7 wherein said wear element is formed of an electrically insulating material having a relative permittivity of greater than 2.

11. The corona igniter of claim 1 wherein said crown presents a crown diameter disposed perpendicular to said central axis, said central extended member presents an extended diameter disposed perpendicular to said central axis, and said extended diameter is less than said crown diameter.

12. The corona igniter of claim 1 wherein said central extended member presents an extended diameter disposed perpendicular to said central axis, and said extended diameter decreases in a direction moving from said crown toward said central firing end.

13. The corona igniter of claim 1 wherein said central extended member presents an extended diameter disposed perpendicular to said central axis, and said extended diameter increases in a direction moving from said crown toward said central firing end.

14. The corona igniter of claim 1, wherein said crown presents a crown length parallel to said central axis between a top surface and said at least one firing tip, said central extended member presents an extended length parallel to said central axis and extending from said top surface of said crown to said central firing end, and said extended length is greater than said crown length.

15. A corona discharge ignition system, comprising:

a cylinder head presenting an opening for receiving a corona igniter;

a piston disposed opposite said cylinder head and presenting a space therebetween;

a cylinder block connected to said cylinder head and surrounding said piston;

said cylinder head and said cylinder block and said piston presenting a combustion chamber therebetween;

a corona igniter received in said opening of said cylinder head;

said corona igniter including a shell coupled to said cylinder head;

said corona igniter including an insulator formed of an electrically insulating material surrounded by said shell and extending along a central axis to an insulator firing end;

said corona igniter including an electrode surrounded by said insulator and extending along said central axis into said combustion chamber for emitting an electrical field that forms a corona discharge;

said electrode including a central extended member extending longitudinally along said central axis to a central firing end;

said electrode including a crown disposed outwardly of said insulator firing end;

said central firing end of said central extended member and said crown being disposed in said combustion chamber;

said crown including at least one branch extending radially outwardly of said central extended member;

said crown extending from a top surface to at least one firing tip;

said crown presenting a crown length between said top surface and said at least one firing tip, said crown length being parallel to said central axis;

said central extended member presenting an extended length extending from said top surface of said crown to said central firing end, said extended length being parallel to said central axis; and said extended length being greater than said crown length; and said crown presenting at least one first spherical radius at each of said firing tips, said central extended member presenting at least one second spherical radius at said central firing end, each of said first spherical radii being smaller than each of said second spherical radii.

16. A method of manufacturing a corona igniter for use in a corona discharge system comprising:

a cylinder head for receiving the corona igniter, a piston disposed opposite the cylinder head for moving toward and away from the cylinder head, a cylinder block connected to the cylinder head and surrounding the piston such that the cylinder head and the cylinder block and the piston present a combustion chamber therebetween;

the corona igniter including a shell received in the cylinder head, an insulator formed of an electrically insulating material surrounded by the shell and extending along a central axis to an insulator firing end, an electrode surrounded by the insulator and extending along the central axis, the electrode including a central extended member extending longitudinally along the central axis to a central firing end, the central extended member presenting at least one second spherical radius at said central firing end, the electrode including a crown disposed outwardly of the insulator firing end and extending radially outwardly of the central extended member to at least one firing tip, the crown presenting at least one first spherical radius at each firing tip; and the method comprising the step of: providing the central extended member and the crown so that each first spherical radius is smaller than each second spherical radius.

17. The method of claim 16 wherein the step of providing the central extended member so that the extended length is greater than the crown length includes: (a) identifying the firing tip of the crown which is closest to the cylinder block when the corona igniter is received in the cylinder head during operation; (b) determining a point during movement of the piston where a distance from the firing tip identified in step (a) to the cylinder block is equal to a distance from the firing tip identified in step (a) to the piston; (c) selecting the extended length of the central extended member such that when power is provided to the electrode and when the firing tip identified in step (a) is at the point identified in step (b), the peak electric field at the central firing end of the central extended member is equal to or greater than the peak electric field at the firing tip identified in step (a).

18. The method of claim 17 including adjusting the extended length of the central extended member to space the central firing end of the central extended member farther from the cylinder block and/or the piston.

19. The method of claim 17 wherein the each of the firing tips of the crown present at least one first spherical radius, the central firing end of the central extended member presents at least one second spherical radius, and the method further comprises: (d) selecting the at least one first spherical radius for each of the firing tips of the crown and selecting the at least one second spherical radius for the central firing end of the central extended member such that the at least one first spherical radius of each of the firing tips is smaller than each of the at least one second spherical radius of the central extended member.

20. The method of claim 19 wherein the peak electric field at the firing tip identified in step (a) at the point identified in step (b) is at least 25% higher than the peak electrode field at the central firing end of the central extended member when power is provided to the electrode and when the firing tip identified in step (a) and the central firing end of the central extended member are spaced from the cylinder block and the piston and when a corona discharge is provided from the crown.

21. The method of claim 16, wherein the crown presents a crown length parallel to the central axis between a top surface and the at least one firing tip, the central extended member presents an extended length parallel to the central axis and extending from the top surface of the crown to the central firing end, and including the step of providing the central extended member so that extended length is greater than said crown length.

22. A method of manufacturing a corona igniter for use in a corona discharge system comprising the steps of:

providing a corona igniter including an electrode extending along a central axis, the electrode including a central extended member extending longitudinally along the central axis to a central firing end, the electrode including a crown, the crown extending from a top surface to at least one firing tip, the at least one firing tip being located radially outwardly of the central extended member, each of the at least one firing tip of the crown presenting at least one first spherical radius, the central firing end of the central extended member presenting at least one second spherical radius; and selecting the at least one first spherical radius for the at least one firing tip of the crown and selecting the at least one second spherical radius for the central firing end of the central extended member such that an electric field at at least one of the at least one firing tip is higher than the electric field at the central firing end of the central extended member when power is provided to the electrode.

23. The method of claim 22, wherein the crown presents a crown length parallel to the central axis between the top surface and the at least one firing tip, the central extended member presents an extended length parallel to the central axis and extending from the top surface of the crown to the central firing end, and the extended length of the central extended member is greater than the crown length.

24. The method of claim 22, wherein the crown extends from a top surface to a bottom surface at the central axis, and the central firing end is disposed longitudinally past the bottom surface at the central axis.

25. A corona igniter for use in a corona discharge system comprising:

an electrode extending along a central axis, said electrode including a central extended member extending longitudinally along said central axis to a central firing end, said electrode including a crown, said crown extending from a top surface to at least one firing tip, said at least one firing tip being located radially outwardly of said central extended member, each of said at least one firing tip of said crown presenting at least one first spherical radius, said central firing end of said central extended member presenting at least one second spherical radius; and said at least one first spherical radius of said at least one firing tip of said crown and said at least one second spherical radius of said central firing end of said central extended member are selected such that an electric field at at least one of said at least one firing tip is higher than the electric field at said central firing end of said central extended member when power is provided to said electrode.

26. The corona igniter of claim 25, wherein said crown presents a crown length parallel to said central axis between said top surface and said at least one firing tip, said central extended member presents an extended length parallel to said central axis and extending from said top surface of said crown to said central firing end, said extended length of said central extended member being greater than said crown length.

27. The corona igniter of claim 25, wherein said crown extends from a top surface to a bottom surface at said central axis, and said central firing end is disposed longitudinally past said bottom surface at said central axis.

* * * * *